United States Patent [19]

Santucci

[11] 4,377,101

[45] Mar. 22, 1983

[54] COMBINATION GUITAR AND BASS

[76] Inventor: Sergio Santucci, Via Ostiense, 30, Rome, Italy, 00154

[21] Appl. No.: 262,325

[22] Filed: May 11, 1981

Related U.S. Application Data

[63] Continuation-in-part of Ser. No. 55,895, Jul. 9, 1979, abandoned.

[51] Int. Cl.[3] ..... G10D 1/08; G10H 3/18

[52] U.S. Cl. ..... 84/1.16; 84/263; 84/267; 84/DIG. 30

[58] Field of Search ..... 84/1.15, 1.16, 263, 84/267, 285, 290, 297 R, 304, 307, 312 R, DIG. 30

[56] References Cited

U.S. PATENT DOCUMENTS

| | | | |
|---|---|---|---|
| 1,828,315 | 10/1931 | Cavicchioli | 84/263 |
| 1,895,383 | 1/1933 | Sullivan | 84/263 |
| 2,897,709 | 8/1959 | McCarty et al. | 84/1.15 |
| 2,964,985 | 12/1960 | Webster | 84/1.15 |
| 3,440,921 | 4/1969 | McCarty | 84/307 |
| 3,673,304 | 6/1972 | Dudas | 84/1.16 X |

*Primary Examiner*—S. J. Witkowski

*Attorney, Agent, or Firm*—Dolgorukov & Dolgorukov

[57] ABSTRACT

A musical instrument comprising an electric guitar and an electric bass in a single instrument having a body to which is attached a neck with enlarged frets so that the neck and the frets may receive at the same time the four strings of the bass as well as the six strings of the common guitar, provided also with a pick-up for the bass as well as with a pick-up for the guitar, both pick-ups leading to a common, single stereo outlet being in turn connected to an already well known amplifier.

9 Claims, 2 Drawing Figures

COMBINATION GUITAR AND BASS

The present application is a continuation-in-part of my earlier filed co-pending application, Ser. No. 06/055,895, filed July 9, 1979, for "Musicial Instrument Comprising a Guitar and an Electric Bass in a Single Handle with Enlarged Frets" and now abandoned.

The present invention concerns a new musical instrument which comprises the features of a common six string guitar and a normal electric bass, with four strings.

It is already well known that at present the guitar and the electric bass form two different instruments which must be, according to the different sounds desired, alternated by the players, and this brings along evident functional limitations. It is, therefore, the aim of the present invention to combine in a single instrument a guitar and a bass which can be played alternately and simultaneously and still produce the same true tones which would be obtained if the guitar and the bass were being played as separate instruments.

The aim set forth is reached realizing a musical instrument provided with a neck having frets which are larger than the ones of the conventional guitar, but smaller than the conventional spacing of bass frets. The frets of the conventional guitar are spaced at intervals of approximately $\frac{7}{8}$ of an inch, while the frets of the bass are spaced approximately $1\frac{1}{2}$ inches apart. I choose to space the frets within the range represented by these two measurements, i.e. somewhere between $\frac{7}{8}$ of an inch and $1\frac{1}{2}$ inches apart. In the preferred embodiment, the frets are spaced $1\frac{3}{8}$ inches apart. As can be seen in the drawings, beneath the six strings of the usual guitar, the four strings of the bass are placed, side by side, still maintaining the features of functionality, tune and musical displacement on the bass key.

According to the present invention, the neck terminates in a widened out portion called the pallet, generally designated by the numeral 15, and having a bass string portion 15A and a guitar string portion 15B. On the bass string portion 15A are placed four bass string tuning devices 20, and on the guitar string portion 15B are placed six guitar string tuning devices 21, therefore said four strings of the bass will be placed on the frets in the usual succession thereof and at the left of the pallet, while at the right thereof the usual six strings of the guitar will be placed.

A further feature of the instrument is, consequently, the presence of an oblique transversal bridge which is longer than the one found on a common guitar, as it must receive the ten strings. For the same reason, the tailpiece will be longer than the common one, as it must receive the same ten strings.

According to the present invention, the pick-up of the bass will be placed on the case of the instrument, said pick-up being independent from the one of the guitar, the first pick-up being placed in the area of the four bass strings 8, and the second in the area of the six guitar strings; each one of said pick-ups is connected, through a single, common outlet, provided in the instrument, to an amplifier consisting, as already known, in two inlet channels and two loud speakers. It should be understood that two separate outlets could be used, if desired.

The objects of the present invention will be now shown, more in detail, relating to the enclosed drawing, showing a front view of the instrument.

Figures 1, 2:
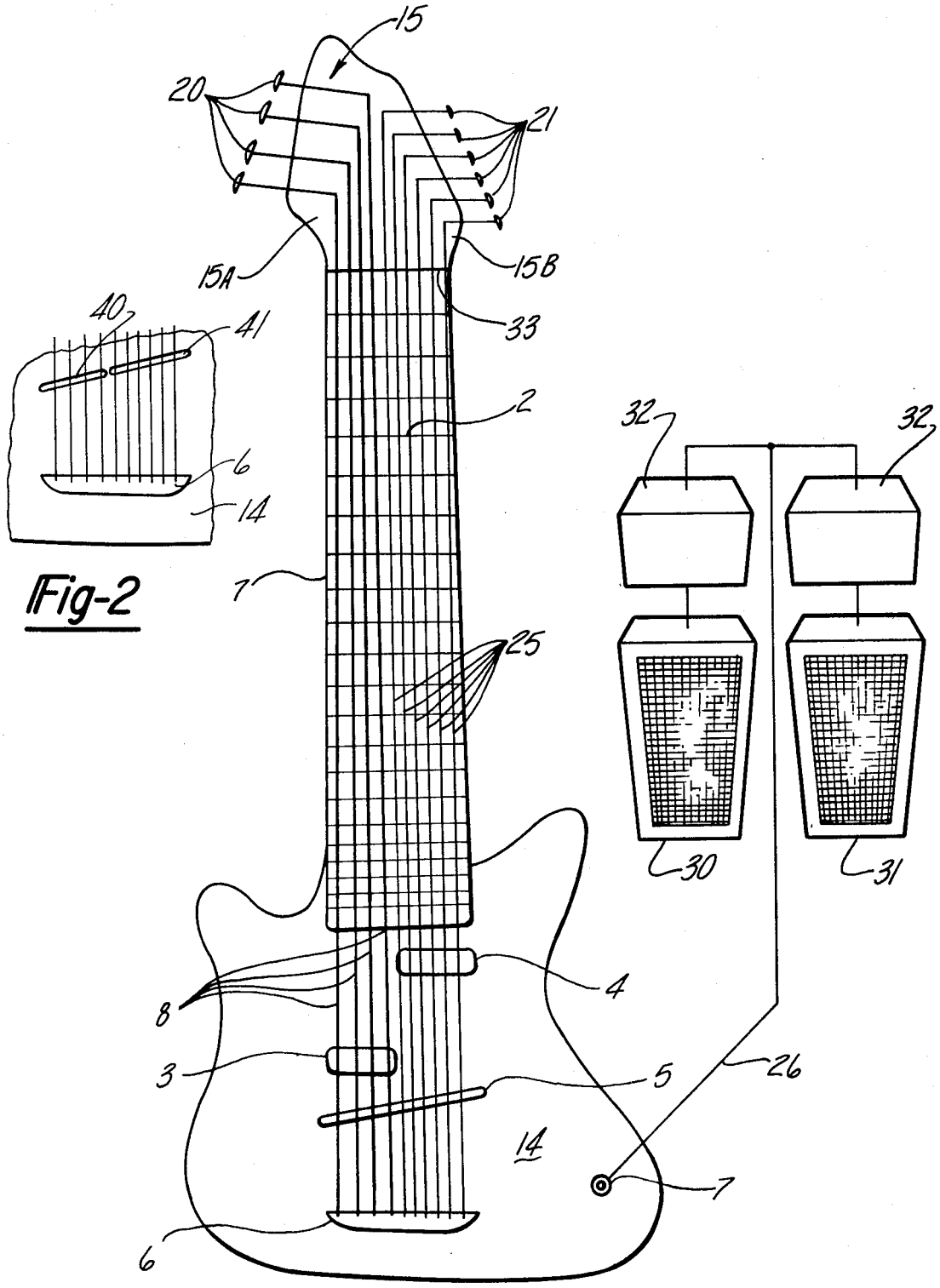
FIG. 1 is a plan view of my combination guitar and bass connected through a common stereo outlet to a pair of amplifiers and a pair of speakers.
FIG. 2 is a partial view showing how a two-piece oblique transversal bridge may be substituted for the one-piece oblique transversal bridge.

A neck 1 is provided, larger than the ones known in the conventional electric guitars. See FIG. 1. This is attached to the body 14, which has mounted thereon an oblique transversal bridge 5 and a tailpiece 6, thus allowing the disposition of the four strings of the bass and the six strings of the guitar and, at the same time, still allow an easy handling of the instrument. The tailpiece should be in the range of four to four and one-half inches, however, to allow sufficient room for proper spacing and mounting of the strings. It being understood that the bass strings are quite a bit larger in diameter than the guitar strings. The exact spacing of the frets and the exact oblique angle at which the oblique transversal bridge 5 is mounted, can be varied experimentally to produce the best arrangement for the particular player of the instrument.

The numeral 2 shows one of the common frets of the neck, it being spaced one from another according to the bigger length of the neck due to the needs of the bass strings. A first pick-up 3 for the bass and a second pick-up 4 for the guitar lead to a common outlet 7, while electric strings 8 of the bass, together with the conventional ones of the guitar, are placed on an oblique transversal bridge 5 and fixed to a tailpiece 6.

If desired, a two-piece oblique transversal bridge comprising a bass section 40 and a guitar section 41 can be used in place of the one-piece oblique transversal bridge 5. See FIG. 2.

Of course, it is evident from the drawings that the first pick-up and the second pick-up are placed underneath the bass 8 and guitar strings 25 respectively at a predetermined position on the body portion 14 of the guitar. To the common stereo outlet 7, connected by suitable electrical wiring designated by the numeral 26, are a bass amplifier 30 and a guitar amplifier 31. Connected one each to the bass amplifier and guitar amplifier are loud speakers 32, thus, completing the equipment necessary to properly amplify and reproduce the sounds of my improved musical instrument. The combination of the enlarged frets 2, combined with the normally heavier bass string construction, and the fixed tailpiece 6, when combined with the fixed oblique transversal bridge 5, combine to render the length of the bass strings 8 and guitar strings 25 proper for providing the traditional bass notes of E, A, D, G, and the traditional guitar notes of E, A, D, G, B, E in a single instrument, with the difference in the fret spacing and the obliqueness of the bridge being the main contributing factors to accomplishing this purpose. It is to be noted that the tailpiece 6, the oblique transversal bridge 5, and the fixed bridge 33 are respectively adapted to keep the strings bearing on them in a flat plane. It should be understood that two separate oblique transversal bridge could be used, if desired.

It is evident that the structure of neck 1 responds to the need for easy handling to allow the two instruments to be played at the same time, still keeping the distinction between the bass and the guitar, by means of the conventional classical play of the right hand, usually by pressure of the thumb on the bass strings 8 for the bass sounds, and by use of the fingers on the guitar strings 25 for the higher sounds.

Also, the left hand, which embraces neck 1, is in condition to play all the strings at the same time, or either the ones of the bass or the ones of the guitar separately or alternatively, according to the music played and the effects desired. This allows the instrument to be played in rapid succession as desired as a bass and a guitar, as while the left hand is performing its conventional function, the right hand, by use of the thumb, can be used to play the bass strings, thus the instrument will be played as a bass for the entire time the thumb of the right hand is pressing on the bass strings, and then can be played as a guitar, placing the fingers of the right hand over the guitar strings. Of course, the instrument comprising my invention and these functions can be reversed if the player is a left-handed player, rather than the normal right-handed player.

The present invention has been described according to a preferred embodiment thereof. It is understood that modifications can be applied to the form, disposition and dimensions thereof without exceeding the scope of the present invention.

I claim:

1. A musical instrument combining a guitar having typical guitar strings and a bass having heavier low frequency bass strings into a single instrument retaining the guitar strings and the heavier low frequency bass strings, said instrument including a body portion, a tailpiece fixedly mounted to said body portion, a neck portion having frets thereon fixedly attached to said body portion in line with said tailpiece, and an oblique transveral bridge also mounted to said body portion separate and apart from said tailpiece and extending in a plane perpendicular to said body portion and at the same time being in a plane oblique to the axis of said neck portion, a pallet portion provided on said neck portion and having a bass string and a guitar string portion, said bass string portion having a plurality of bass string tuning devices mounted thereto, said guitar string portion having a plurality of guitar string tuning devices mounted thereto, a plurality of bass strings attached one each between said bass string tuning device and said tailpiece and passing over said oblique transversal bridge, a plurality of guitar strings attached one each between said guitar string tuning devices and said tailpiece and passing over said oblique transversal bridge, a first sound pick-up mounted beneath said bass strings, a second sound pick-up mounted beneath said guitar strings, and a stereo outlet connected to said first and said second sound pick-ups.

2. The device defined in claim 1, and including a fixed bridge adapted to keep said guitar and said bass strings in a flat plane.

3. The device defined in claim 2, and having four bass strings and six guitar strings.

4. The device in claim 3, wherein said fixed tailpiece, said oblique transversal bridge, and said four bass strings and said guitar strings cooperate to produce the traditional bass notes of E, A, D, G on said four bass strings and notes of E, A, D, G, B, E on said six guitar strings.

5. The musical instrument defined in claim 4, wherein said tailpiece ranges in length from 4" to $4\frac{1}{2}$".

6. The device defined in claim 5, wherein said frets are spaced apart in the range of $\frac{7}{8}$ of an inch to $1\frac{1}{2}$ inches.

7. The device defined in claim 6, and including a bass amplifier connected to said bass string pick-up and a guitar amplifier connected to said guitar string pick-up through said stereo outlet.

8. The device defined in claim 7, and including a pair of loud speakers, connected one each to said bass amplifier and said guitar string amplifier.

9. The device defined in any one of claims 1–8, and having a two-piece oblique transversal bridge.

* * * * *